US008855889B2

(12) United States Patent
Dölker

(10) Patent No.: US 8,855,889 B2
(45) Date of Patent: Oct. 7, 2014

(54) METHOD FOR REGULATING THE RAIL PRESSURE IN A COMMON RAIL INJECTION SYSTEM OF AN INTERNAL COMBUSTION ENGINE

(75) Inventor: Armin Dölker, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 404 days.

(21) Appl. No.: 13/382,110

(22) PCT Filed: Jun. 17, 2010

(86) PCT No.: PCT/EP2010/003653

§ 371 (c)(1),
(2), (4) Date: Jan. 3, 2012

(87) PCT Pub. No.: WO2011/000479

PCT Pub. Date: Jan. 6, 2011

(65) Prior Publication Data

US 2012/0166063 A1 Jun. 28, 2012

(30) Foreign Application Priority Data

Jul. 2, 2009 (DE) ..... 10 2009 031 529

(51) Int. Cl.

| | |
|---|---|
| ***F02D 41/26*** | (2006.01) |
| ***F02D 41/38*** | (2006.01) |
| ***F02M 63/02*** | (2006.01) |
| *F02D 41/14* | (2006.01) |
| *F02D 41/04* | (2006.01) |
| *F02D 41/20* | (2006.01) |
| *F02D 41/06* | (2006.01) |

(52) U.S. Cl.

CPC ..... *F02D 41/1401* (2013.01); *F02D 41/3863* (2013.01); *F02M 63/025* (2013.01); *F02D 2041/1411* (2013.01); *F02D 41/3845* (2013.01); *F02D 2250/04* (2013.01); *F02D 41/042* (2013.01); *F02D 2041/2027* (2013.01); *F02D 2041/1432* (2013.01); *F02D 2041/141* (2013.01); *F02D 2200/0602* (2013.01); *F02D 2250/31* (2013.01); *F02D 41/062* (2013.01)

USPC ..... 701/102; 123/456; 701/114

(58) Field of Classification Search

USPC ..... 701/102–105, 113, 114; 123/446, 447, 123/456, 457, 495, 511, 514, 198 D, 179.1, 123/179.3, 179.4, 198 DB, 198 F

See application file for complete search history.

(56) References Cited

U.S. PATENT DOCUMENTS 5,878,718 A * 3/1999 Rembold et al. ..... 123/456
6,119,655 A 9/2000 Heinitz et al.

(Continued)

FOREIGN PATENT DOCUMENTS

DE 19708308 A 9/1998
DE 19731995 1/1999

(Continued)

*Primary Examiner* — John Kwon
*Assistant Examiner* — Johnny H Hoang
(74) *Attorney, Agent, or Firm* — Lucas & Mercanti, LLP; Klaus P. Stoffel

(57) ABSTRACT

A method for open-loop and closed-loop control of an internal combustion engine (1) in which the rail pressure (pCR) is controlled via a low pressure-side suction throttle (4), as the first pressure-adjusting element in a rail pressure control loop. A rail pressure disturbance variable (VDRV) is generated to influence the rail pressure (pCR) via a high-pressure side pressure control valve (12), as the second pressure-adjusting element, by which fuel is redirected from the rail (6) into the fuel tank (2). The position of the high-pressure side pressure control valve (12) is determined by a PWM signal (PWMDV), which, when normal mode is set, is calculated as a function of the resulting target volume flow and, when protective mode is set, is temporarily set to a maximum value.

8 Claims, 10 Drawing Sheets

(56) References Cited

U.S. PATENT DOCUMENTS

| | | | | |
|---|---|---|---|---|
| 6,155,234 | A | 12/2000 | Hartke et al. | |
| 6,823,847 | B2 | 11/2004 | Carlo | |
| 6,948,480 | B2 * | 9/2005 | Eser et al. | 123/495 |
| 7,171,952 | B2 * | 2/2007 | Joos et al. | 123/457 |
| 7,240,667 | B2 | 7/2007 | Dölker | |
| 7,270,115 | B2 | 9/2007 | Dölker | |
| 7,441,546 | B2 * | 10/2008 | Mitsumata et al. | 123/472 |
| 7,532,973 | B2 * | 5/2009 | Akasaka | 701/112 |
| 7,779,816 | B2 | 8/2010 | Dölker | |
| 2005/0005912 | A1 * | 1/2005 | Joos et al. | 123/458 |
| 2007/0056561 | A1 * | 3/2007 | Dolker | 123/458 |
| 2007/0213918 | A1 * | 9/2007 | Achleitner et al. | 701/101 |
| 2008/0092852 | A1 * | 4/2008 | Bucher et al. | 123/457 |
| 2008/0103674 | A1 * | 5/2008 | Kosiedowski et al. | 701/103 |

FOREIGN PATENT DOCUMENTS

| | | | |
|---|---|---|---|
| DE | 19802583 | Y | 8/1999 |
| DE | 10261414 | | 7/2004 |
| DE | 10261446 | A | 7/2004 |
| DE | 10330466 | | 10/2004 |
| DE | 102004061474 | A1 | 3/2006 |
| DE | 102005008039 | Y | 6/2006 |
| DE | 102006040441 | | 2/2008 |
| EP | 1382827 | A | 1/2004 |
| WO | 2005111402 | Y | 11/2005 |
| WO | 2006136414 | Y | 12/2006 |

* cited by examiner

QSL nMOT [1/min] →

27

QSL [mm³/stroke] →

| | 0 | ... | 1000 | ... | 2000 |
|---|---|---|---|---|---|
| 270 | 0 | ... | 0 | ... | 0 |
| 240 | 0 | ... | 0 | ... | 0 |
| . | . | | . | | . |
| 120 | 0 | ... | 0 | ... | 0 |
| 90 | 0.5 | ... | 0.5 | ... | 0.5 |
| 60 | 1 | ... | 1 | ... | 1 |
| 30 | 1.5 | ... | 1.5 | ... | 1.5 |
| 0 | 2 | ... | 2 | ... | 2 |

METHOD FOR REGULATING THE RAIL PRESSURE IN A COMMON RAIL INJECTION SYSTEM OF AN INTERNAL COMBUSTION ENGINE

The present application is a 371 of International application PCT/EP2010/003653, filed Jun. 17, 2010, which claims priority of DE 10 2009 031 529.2, filed Jul. 2, 2009, the priority of these applications is hereby claimed and these applications are incorporated herein by reference.

BACKGROUND OF THE INVENTION

The invention concerns a method for the open-loop and closed-loop control of an internal combustion engine.

In an internal combustion engine with a common rail system, the quality of combustion is critically determined by the pressure level in the rail. Therefore, in order to stay within legally prescribed emission limits, the rail pressure is automatically controlled. A closed-loop rail pressure control system typically comprises a comparison point for determining a control deviation, a pressure controller for computing a control signal, the controlled system, and a software filter in the feedback path for computing the actual rail pressure. The control deviation is computed as the difference between a set rail pressure and the actual rail pressure. The controlled system comprises the pressure regulator, the rail, and the injectors for injecting the fuel into the combustion chambers of the internal combustion engine.

DE 197 31 995 A1 discloses a common rail system with closed-loop pressure control, in which the pressure controller is equipped with various controller parameters. The various controller parameters are intended to make the automatic pressure control more stable. The pressure controller then uses the controller parameters to compute the control signal for a pressure control valve, by which the fuel drain-off from the rail into the fuel tank is set. Consequently, the pressure control valve is arranged on the high-pressure side of the common rail system. This source also discloses an electric pre-feed pump or a controllable high-pressure pump as alternative measures for automatic pressure control.

DE 103 30 466 B3 also describes a common rail system with closed-loop pressure control, in which, however, the pressure controller acts on a suction throttle by means of a control signal. The suction throttle in turn sets the admission cross section to the high-pressure pump. Consequently, the suction throttle is arranged on the low-pressure side of the common rail system. This common rail system can be supplemented by a passive pressure control valve as a protective measure against an excessively high rail pressure. The fuel is then redirected from the rail into the fuel tank via the opened pressure control valve. A similar common rail system with a passive pressure control valve is known from DE 10 2006 040 441 B3.

Control leakage and constant leakage occur in a common rail system as a result of design factors. Control leakage occurs when the injector is being electrically activated, i.e., for the duration of the injection. Therefore, the control leakage decreases with decreasing injection time. Constant leakage is always present, i.e., even when the injector is not activated. This is also caused by part tolerances. Since the constant leakage increases with increasing rail pressure and decreases with falling rail pressure, the pressure fluctuations in the rail are damped. In the case of control leakage, on the other hand, the opposite behavior is seen. If the rail pressure rises, the injection time is shortened to produce a constant injection quantity, which leads to decreasing control leakage.

If the rail pressure drops, the injection time is correspondingly increased, which leads to increasing control leakage. Consequently, control leakage leads to intensification of the pressure fluctuations in the rail. Control leakage and constant leakage represent a loss volume flow, which is pumped and compressed by the high-pressure pump. However, this loss volume flow means that the high-pressure pump must be designed larger than necessary. In addition, some of the motive energy of the high-pressure pump is converted to heat, which in turn causes heating of the fuel and reduced efficiency of the internal combustion energy.

In present practice, to reduce the constant leakage, the parts are cast together. However, a reduction of the constant leakage has the disadvantages that the stability behavior of the common rail system deteriorates and that automatic pressure control becomes more difficult. This becomes clear in the low-load range, because here the injection quantity, i.e., the removed fuel volume, is very small. This also becomes clear in a load reduction from 100% to 0%, since here the injection quantity is reduced to zero, and therefore the rail pressure is only slowly reduced again. This in turn results in a long correction time.

SUMMARY OF THE INVENTION

Proceeding from a common rail system with automatic rail pressure control by a suction throttle on the low-pressure side and with reduced constant leakage, the objective of the invention is to optimize the stability behavior and the correction time.

The method consists not only in providing closed-loop rail pressure control by means of the suction throttle on the low-pressure side as the first pressure regulator, but also in generating a rail pressure disturbance variable for influencing the rail pressure by means of a pressure control valve on the high-pressure side as a second pressure regulator. Fuel is redirected from the rail into a fuel tank by the pressure control valve on the high-pressure side, the position of which is determined by a PWM signal. In addition, the method consists in computing the PWM signal as a function of a resultant set volume flow when the normal mode is set and in setting the PWM signal temporarily to a maximum value when the protective mode is set. A higher fuel volume flow is temporarily diverted from the rail by means of the protective mode, so that the rise in rail pressure is reduced and the rail is protected from pressure peaks. An undesired response of the passive pressure control valve thus is also prevented, so that this response is limited to actual emergencies.

The protective mode is set when a dynamic rail pressure rises above a maximum value to enable the protective mode. In this regard, the maximum value is selected in such a way that the rail pressure in steady-state operation does not reach this pressure value. The dynamic rail pressure is computed from the raw values of the rail pressure by a fast filter. The protective mode is dropped and operation is returned to normal mode again when a predetermined time interval has elapsed. Swinging between the two modes is eliminated by virtue of the fact that after the change from protective mode back to normal mode, the protective mode is blocked and is not released again until the dynamic rail pressure falls below the maximum pressure value by a hysteresis value.

In one embodiment, it is proposed that when the normal mode is set, it is dropped and shutdown mode is set when engine shutdown is detected, with a PWM signal of zero being output when shutdown mode is set. The change from shutdown mode to normal mode occurs when the actual rail pressure rises above an initial value and a verified engine speed is detected, i.e., when at the same time the internal combustion engine is detected as rotating. It is an advantage that when the engine is being started, the rail pressure is reliably built up.

The resultant set volume flow is computed from a static and a dynamic set volume flow. The static set volume flow in turn is computed as a function of a set injection quantity and the engine speed by means of a set volume flow input-output map. In a torque-oriented structure, a set torque is used instead of the set injection quantity. A constant leakage is reproduced by means of the static set volume flow by redirecting the fuel only in the low-load range and in small quantities. It is advantageous that there is no significant increase in the fuel temperature and also no significant reduction of the efficiency of the internal combustion engine. The increased stability of the closed-loop rail pressure control system in the low-load range can be recognized, for example, from the fact that the rail pressure in the coasting range remains more or less constant. The dynamic set volume flow is computed by a dynamic correction unit as a function of a set rail pressure and the actual rail pressure or the control deviation computed from them. If the control deviation is negative, for example, in the case of a load reduction, the static set volume flow is corrected by means of the dynamic set volume flow. Otherwise, no change is made in the static set volume flow. The pressure increase of the rail pressure is counteracted by means of the dynamic set volume flow, with the advantage that the correction time of the system can be improved once again.

The drawings illustrate a preferred embodiment of the invention.

DETAILED DESCRIPTION OF THE INVENTION

Figure 1:
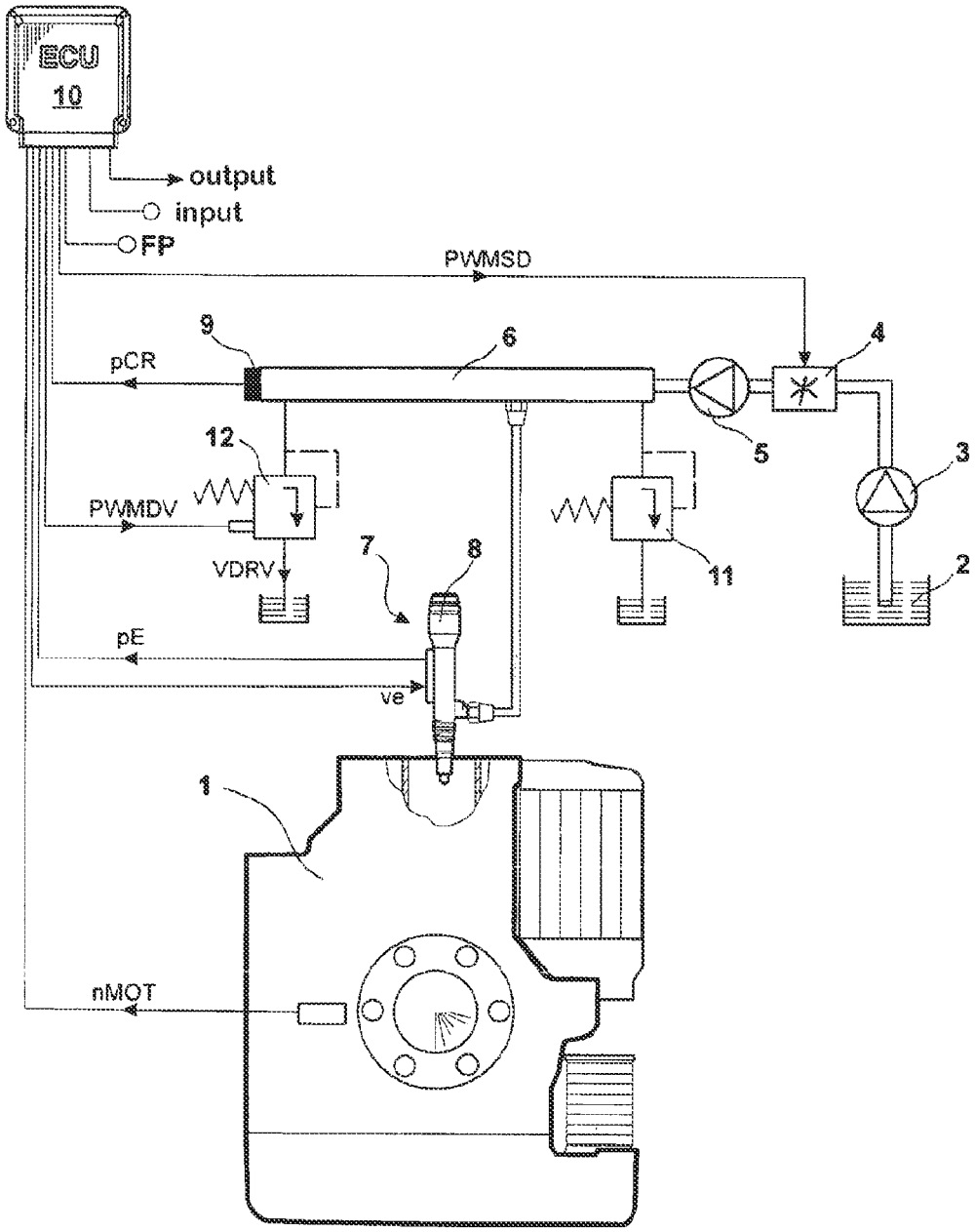
FIG. 1 is a system diagram.

FIG. 1 shows a system diagram of an electronically controlled internal combustion engine 1 with a common rail system. The common rail system comprises the following mechanical components: a low-pressure pump 3 for pumping fuel from a fuel tank 2, a variable suction throttle 4 on the low-pressure side for controlling the fuel volume flow flowing through the lines, a high-pressure pump 5 for pumping the fuel at increased pressure, a rail 6 for storing the fuel, and injectors 7 for injecting the fuel into the combustion chambers of the internal combustion engine 1. Optionally, the common rail system can also be realized with individual accumulators, in which case an individual accumulator 8 is integrated, for example, in the injector 7 as an additional buffer volume. To protect against an impermissibly high pressure level in the rail 6, a passive pressure control valve 11 is provided, which, in its open state, redirects the fuel from the rail 6. An electrically controllable pressure control valve 12 also connects the rail 6 with the fuel tank 2. A fuel volume flow redirected from the rail 6 into the fuel tank 2 is defined by the position of the pressure control valve 12. In the remainder of the text, this fuel volume flow is denoted the rail pressure disturbance variable VDRV.

The operating mode of the internal combustion engine 1 is determined by an electronic control unit (ECU) 10. The electronic control unit 10 contains the usual components of a microcomputer system, for example, a microprocessor, interface adapters, buffers and memory components (EEPROM, RAM). Operating characteristics that are relevant to the operation of the internal combustion engine 1 are applied in the memory components in the form of input-output maps/characteristic curves. The electronic control unit 10 uses these to compute the output variables from the input variables. FIG. 1 shows the following input variables as examples: the rail pressure pCR, which is measured by means of a rail pressure sensor 9, an engine speed nMOT, a signal FP, which represents an engine power output desired by the operator, and an input variable INPUT, which represents additional sensor signals, for example, the charge air pressure of an exhaust gas turbocharger. In a common rail system with individual accumulators 8, the individual accumulator pressure pE is an additional input variable of the electronic control unit 10.

FIG. 1 also shows the following as output variables of the electronic control unit 10: a signal PWMSD for controlling the suction throttle 4 as the first pressure regulator, a signal ve for controlling the injectors 7 (injection start/injection end), a signal PWMDV for controlling the pressure control valve 12 as the second pressure regulator, and an output variable OUTPUT. The signal PWMDV defines the position of the pressure control valve 12 and thus the rail pressure disturbance variable VDRV. The output variable OUTPUT is representative of additional control signals for the open-loop and closed-loop control of the internal combustion engine 1, for example, a control signal for activating a second exhaust gas turbocharger during a register supercharging.

Figure 2:
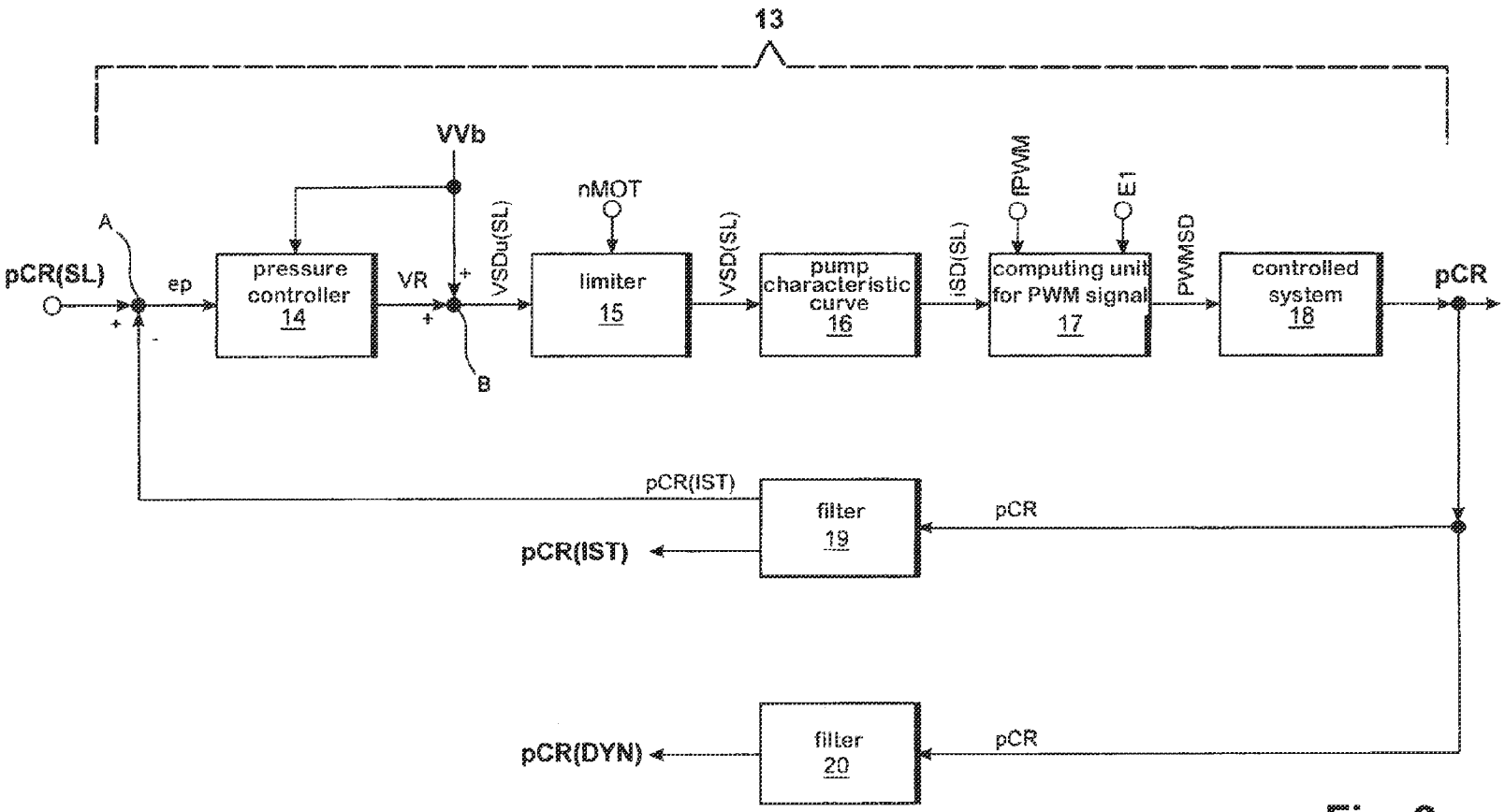
FIG. 2 is a closed-loop rail pressure control system.

FIG. 2 shows a closed-loop rail pressure control system 13 for automatically controlling the rail pressure pCR. The input variables of the closed-loop rail pressure control system 13 are: a set rail pressure pCR(SL), a volume flow that characterizes the set consumption VVb, the engine speed nMOT, the PWM base frequency fPWM, and a variable E1. The variable E1 combines, for example, the battery voltage and the ohmic resistance of the suction throttle coil with lead-in wire, which enter into the computation of the PWM signal. The output variables of the closed-loop rail pressure control system 13 are the raw value of the rail pressure pCR, an actual rail pressure pCR(IST), and a dynamic rail pressure pCR(DYN). The actual rail pressure pCR(IST) and the dynamic rail pressure pCR(DYN) are further processed in the open-loop control system shown in FIG. 3.

Figure 3:
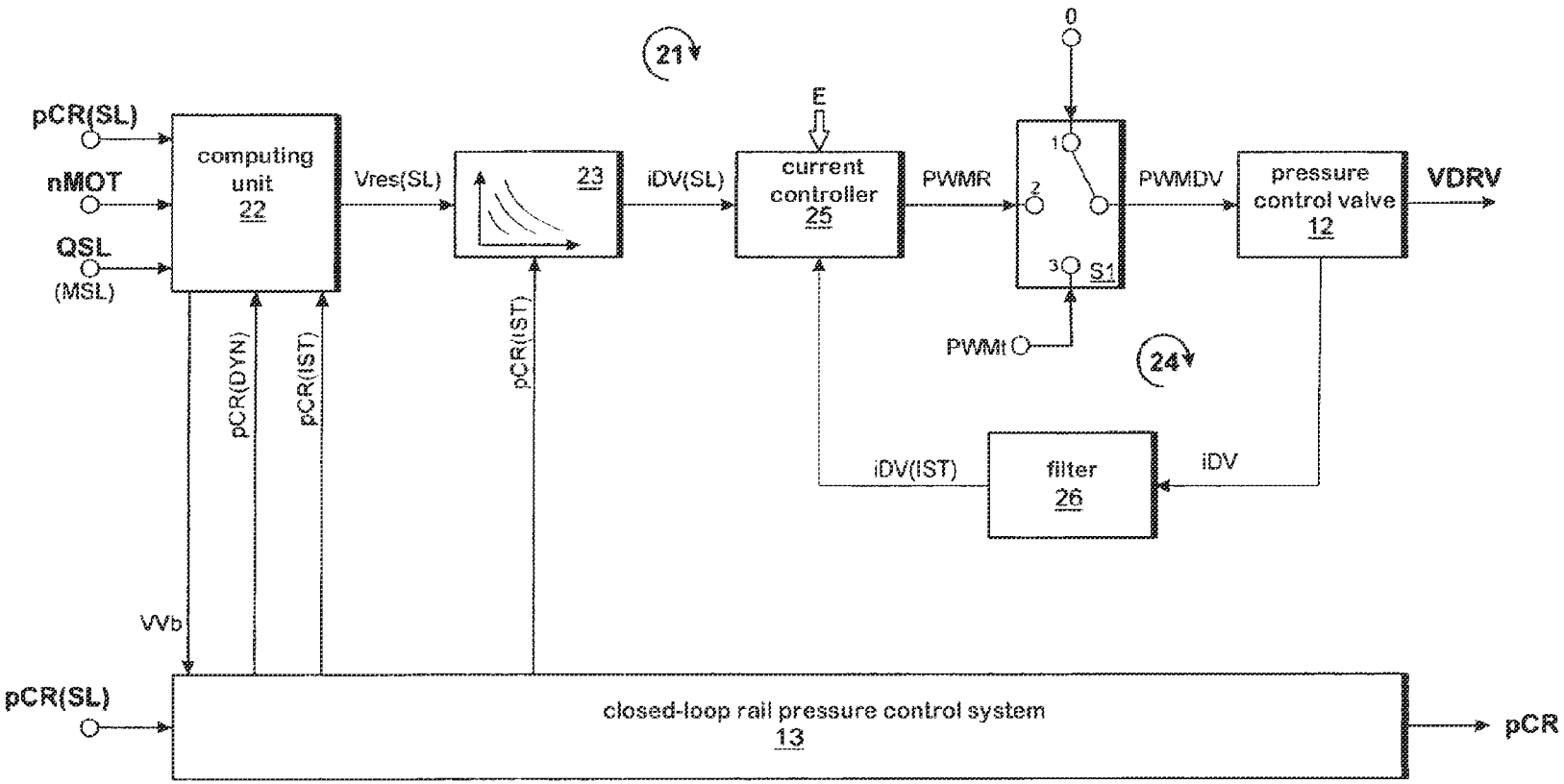
FIG. 3 is a block diagram of the closed-loop rail pressure control system with an open-loop control system.

The actual rail pressure pCR(IST) is computed from the raw value of the rail pressure pCR by means of a first filter 19. This value is then compared with the set value pCR(SL) at a summation point A, and a control deviation ep is obtained from this comparison. A correcting variable is computed from the control deviation ep by means of a pressure controller 14. The correcting variable represents a volume flow VR with the physical unit of liters/minute. The computed set consumption VVb is added to the volume flow VR at a summation point B. The set consumption VVb is computed by a computing unit 23, which is shown in FIG. 3 and will be explained in connection with the description of FIG. 3. The result of the addition at summation point B represents an unlimited set volume flow VSDu(SL). The unlimited set volume flow VSDu(SL) is then limited by a limiter 15 as a function of the engine speed nMOT. The output variable of the limiter 15 is a set volume flow VSD(SL) of the suction throttle. A set electric current iSD(SL) of the suction throttle is then assigned to the set volume flow VSD(SL) by the pump characteristic curve 16. The set current iSD(SL) is converted to a PWM signal PWMSD in a computing unit 17. The PWM signal PWMSD represents the duty cycle, and the frequency fPWM corresponds to the base frequency. The magnetic coil of the suction throttle is then acted upon by the PWM signal PWMSD. This changes the displacement of the magnetic core, and the output of the high-pressure pump is freely controlled in this way. For safety reasons, the suction throttle is open in the absence of current and is acted upon by current via PWM activation to move in the direction of the closed position. A closed-loop current control system can be subordinate to the PWM signal computing unit 17, as described in DE 10 2004 061 474 A1. The high-pressure pump, the suction throttle, the rail, and possibly the individual accumulators represent a controlled system 18. The closed-loop control system is thus closed. A dynamic rail pressure pCR(DYN) is computed from the raw value of the rail pressure pCR by means of a first filter 20. The dynamic rail pressure pCR(DYN) is one of the input variables of the block diagram of FIG. 3. In this regard, the second filter 20 has a smaller time constant and smaller phase distortion than the first filter 19 in the feedback path.

FIG. 3 in the form of a block diagram shows the greatly simplified closed-loop rail pressure control system 13 of FIG. 2 and an open-loop control system 21. The open-loop control system 21 generates the rail pressure disturbance variable VDRV, i.e., that volume flow which the pressure control valve redirects into the fuel tank from the rail. The input variables of the open-loop control system 21 are: the set rail pressure pCR(SL), the actual rail pressure pCR(IST), the dynamic rail pressure pCR(DYN), the engine speed nMOT, and a set injection quantity QSL. The set injection quantity QSL is either computed by an input-output map as a function of the power desired by the operator or represents the correcting variable of a speed controller. The physical unit of the set injection quantity QSL is $mm^3$/stroke. A set torque MSL can be used as an alternative to the set injection quantity QSL. The output variables are the set consumption VVb, which is supplied to the closed-loop rail pressure control system, and the rail pressure disturbance variable VDRV. A resultant set volume flow Vres (SL) is determined from a static component and a dynamic component by a computing unit 22. The computing unit 22 is shown as a block diagram in FIG. 4 and will be explained in the description of FIG. 4. The resultant set volume flow Vres (SL) and the actual rail pressure pCR(IST) are the input variables of a pressure control valve input-output map 23, which computes a set current iDV(SL) of the pressure control valve. The set current iDV(SL) in turn is the reference input for a closed-loop current control system 24. The closed-loop current control system 24 comprises a current controller 25, a switch S1, the pressure control valve 12 as the controlled system, and a filter 26 in the feedback path. The current controller 25 is shown in FIG. 5 and will be explained in the description of FIG. 5. The current controller 25 outputs a PWM signal PWMR as a correcting variable, which is an input variable of the switch S1. The other two input signals of the switch S1 are the value zero and a temporary PWM signal PWMt. The temporary PWM signal PWMt is realized in such a form that an increased PWM value, for example, 80%, is output for a timed interval. Different functional modes are produced by the switch S1. If the switch is in position S1=1, then the shutdown mode is set. In position S1=2, the normal mode is set, and in position S1=3, the protective mode is set. The output signal of the switch S1 is then the PWM signal PWMDV, with which the pressure control valve 12 is controlled. The electric current iDV that develops at the pressure control valve 12 is measured, and the actual current iDV(IST) is computed by the filter 26 and then fed back to the current controller 25. The closed-loop current control system 24 is thus closed.

Figure 4:
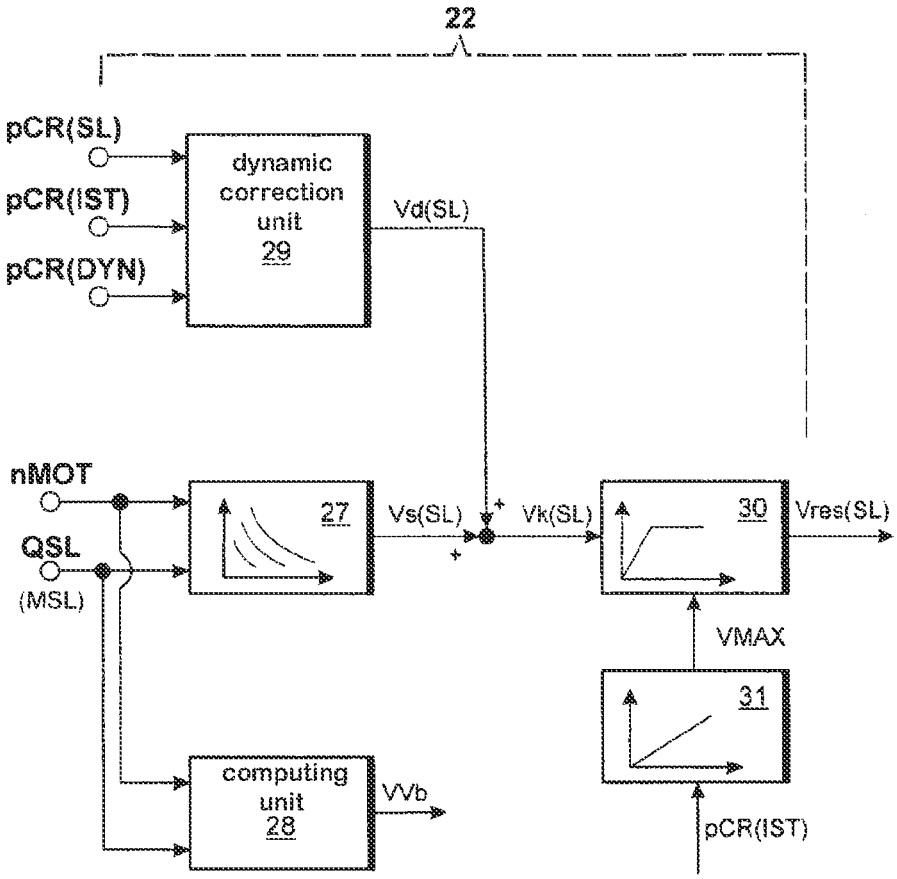
FIG. 4 is a block diagram of a computing unit.
Figure 5:
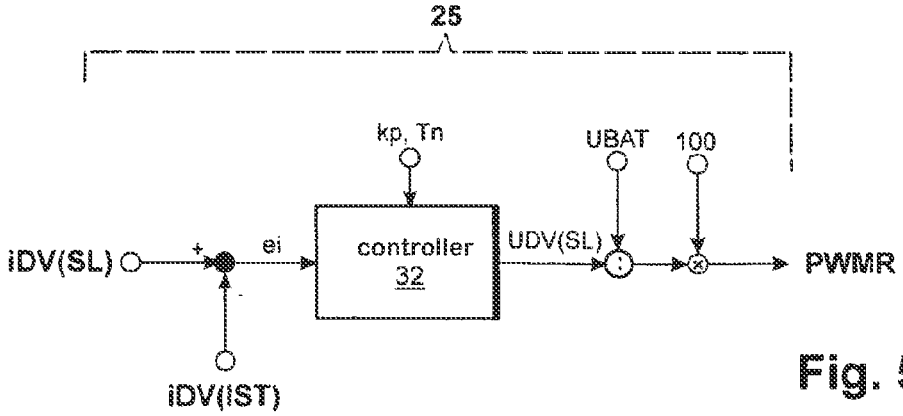
FIG. 5 is a current controller.
Figures 6, 7:
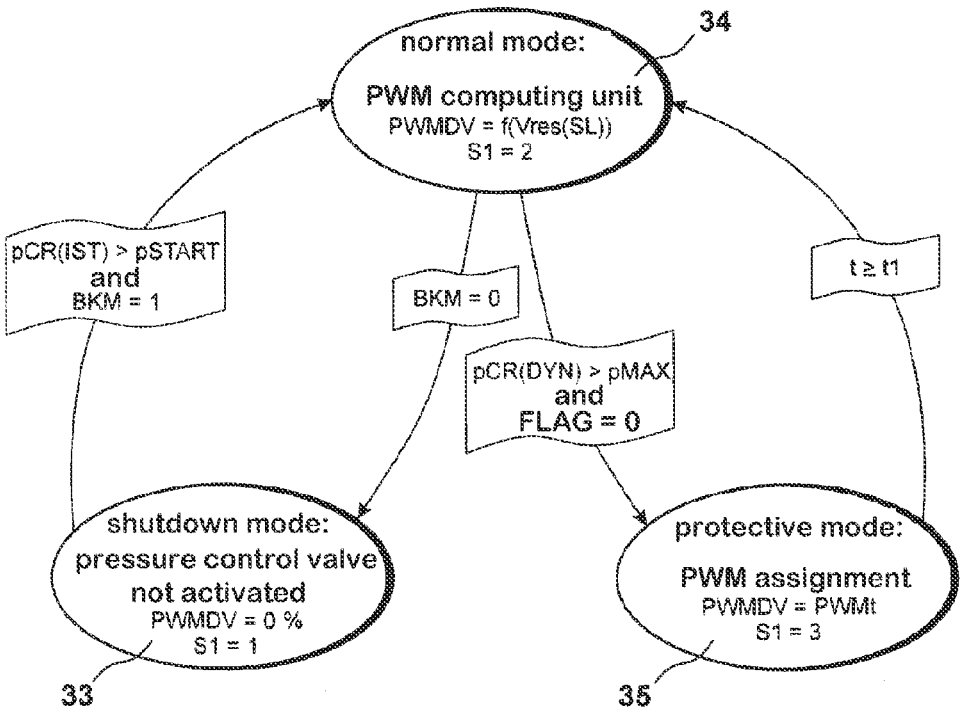
FIG. 6 is a set volume flow input-output map.
FIG. 7 is a diagram of the functional modes.

FIG. 4 shows the computing unit 22 as a block diagram. The input variables are the set rail pressure pCR(SL), the actual rail pressure pCR(IST), the dynamic rail pressure pCR (DYN), the engine speed nMOT, and the set injection quantity QSL or, alternatively, the set torque MSL. The output variables are the set consumption VVb and the resultant set volume flow Vres(SL). A set volume flow input-output map 27 (3D input-output map) uses the engine speed nMOT and the set injection quantity QSL to compute the static set volume flow Vs(SL) for the pressure control valve. The set volume flow input-output map 27 is realized in such a form that in the low-load range, for example, at idle, a positive value of the static set volume flow Vs(SL) is computed, while in the normal operating range a static set volume flow Vs(SL) of zero is computed. A concrete embodiment of the set volume flow input-output map 27 is shown in FIG. 6 and will be explained in detail in the description of FIG. 6. A computing unit 28 also uses the engine speed nMOT and the set injection quantity QSL to compute the set consumption VVb, which is one of the input variables of the closed-loop rail pressure control system 13. The static set volume flow Vs(SL) is corrected by adding a dynamic set volume flow Vd(SL). The dynamic set volume flow Vd(SL) is computed by a dynamic correction unit 29 as a function of the control deviation. The control deviation in turn is computed as the difference between the set rail pressure pCR(SL) and the actual rail pressure pCR(IST). Alternatively, the control deviation can also be computed as the difference between the set rail pressure pCR(SL) and the dynamic rail pressure pCR(DYN). For a control deviation greater than or equal to zero, a dynamic set volume flow Vd(SL) of zero liters/minute is output. On the other hand, if the control deviation is negative, for example, in the case of a load reduction, then, when the control deviation falls below a limit, a larger and larger dynamic set volume flow Vd(SL) is computed. In short, the pressure control valve then redirects a greater and greater fuel volume flow into the fuel tank. The sum of the static volume flow Vs(SL) and the dynamic set volume flow Vd(SL) is a corrected set volume flow Vk(SL), which is limited above to a maximum volume flow VMAX and below to a value of zero by a limiter 30. The maximum volume flow VMAX is computed by a (2D) characteristic curve 31 as a function of the actual rail pressure pCR(IST). The output variable of the limiter 30 is then the resultant set volume flow Vres(SL).

FIG. 5 shows the current controller 25 from FIG. 3. The input variables are the set current iDV(SL) for the pressure control valve, the actual current iDV(IST) of the pressure control valve, the battery voltage UBAT, and controller parameters (kp, Tn). The output variable is the PWM signal PWMR. First, the current control deviation ei is computed from the set current iDV(SL) and the actual current iDV(IST). The current control deviation ei is the input variable of the controller 32. The controller 32 can be realized as a PI or PI(DT1) algorithm. The controller parameters are processed in the algorithm. They are characterized, for example, by the proportional coefficient kp and the integral-action time Tn. The output variable of the controller 32 is a set voltage UDV (SL) of the pressure control valve. This is divided by the battery voltage UBAT and then multiplied by 100. The result is the duty cycle of the PWM signal PWMR in percent.

Optionally, an input control can also be present, which computes a voltage component from the set current iDV(SL) and the ohmic resistance of the pressure control valve. This voltage component is then added to the set voltage UDV(SL).

FIG. 6 shows the set volume flow input-output map 27, with which the static set volume flow Vs(SL) for the pressure control valve is determined. The input variables are the engine speed nMOT and the set injection quantity QSL. Engine speed values of 0 to 2000 rpm are plotted in the horizontal direction, and set injection quantity values of 0 to 270 $mm^3$/stroke are plotted in the vertical direction. The values inside the input-output map then represent the assigned static set volume flow Vs(SL) in liters/minute. A portion of the fuel volume flow to be redirected is determined by the set volume flow input-output map 27. The set volume flow input-output map 27 is realized in such a form that in the normal operating range a static set volume flow of Vs(SL)=0 liters/minute is computed. The normal operating range is outlined by a double line in FIG. 6. The region outlined by a single line corresponds to the low-load range. In the low-load range, a positive value of the static set volume flow Vs(SL) is computed. For example, at nMOT=1000 rpm and QSL=30 $mm^3$/stroke, a static set volume flow of Vs(SL)=1.5 liters/minute is determined.

FIG. 7 shows a diagram of the functional modes that can be realized by the switch S1 (FIG. 3). Reference number 33 designates the shutdown mode, reference number 34 the normal mode, and reference number 35 the protective mode. The shutdown mode is set when an engine shutdown is detected. When shutdown mode is set, the pressure control valve is not activated, since the switch S1 is in position 1 and therefore a PWM value of zero is output. Accordingly, PWMDV=0. If the actual rail pressure pCR(IST) rises above an initial value pSTART, for example, pSTART=800 bars, and a verified engine speed nMOT is present (BKM=1), i.e., if the internal combustion engine is detected as rotating, the shutdown mode is terminated and normal mode 34 is set. In the transition from shutdown mode 33 to normal mode 34, the switch S1 moves into the position S1=2. When normal mode 34 is set, the PWM signal PWMDV for controlling the pressure control valve is computed as a function of the resultant set volume flow Vres(SL). Accordingly, PWMDV=f(Vres(SL)). A change back to shutdown mode 33 occurs if an engine shutdown is detected (BKM=0). If, while normal mode 34 is set, it is detected that the dynamic rail pressure pCR(DYN) exceeds a maximum pressure value pMAX, an interrogation is carried out to determine whether the protective mode 35 has been enabled. This occurs by means of a flag. Swinging back and forth between normal mode and protective is prevented by the flag. If the protective mode 35 is enabled (flag=0), the normal mode 34 is terminated and the protective mode 35 is set. With the change in mode, the switch S1 is switched over to the position S1=3. In this position, the PWM signal PWMDV is temporarily set to a maximum value, for example, PWMt=80%. Accordingly, PWMDV=PWMt. This time function can also be realized as a timed step function with different values, for example, value 1 PWMt=80% and value 2 PWMt=60%. If a time interval t1 has elapsed, then the protective mode 35 is terminated and the normal mode 34 is set. The switch S1 changes its position from S1=3 to S1=2. The protective mode 35 is not enabled again until the dynamic rail pressure pCR(DYN) falls below the maximum pressure value pMAX by a hysteresis value pHY.

Figure 8:
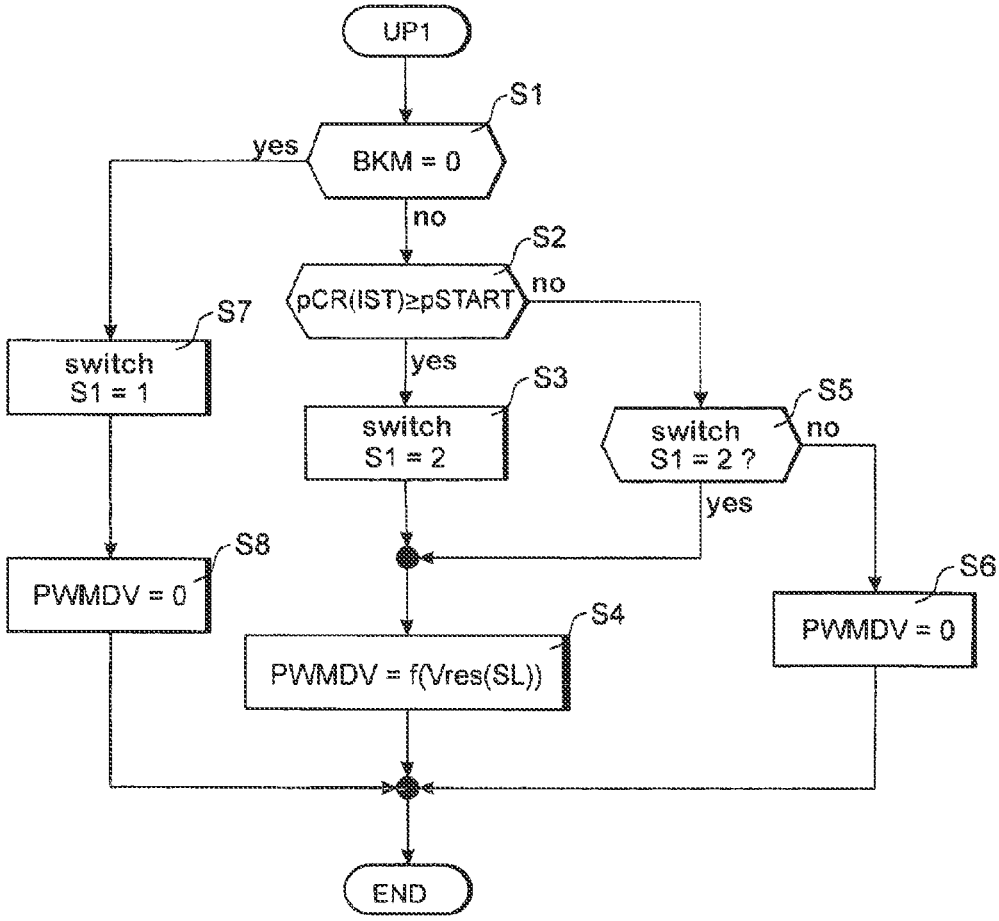
FIG. 8 is a first subroutine.

FIG. 8 is a first subroutine UP1 showing the transition from shutdown mode to normal mode. At S1 an interrogation is carried out to determine whether an engine shutdown has occurred. An engine shutdown is detected if the engine speed nMOT falls below a limiting speed, for example, 80 rpm, for a certain time interval, for example, 2.5 seconds. If this is the case (interrogation result S1: yes), then at S7 the switch S1 is switched to the position S1=1, at S8 a PWM signal with a value of zero (PWMDV=0) is output, and the program ends. The shutdown mode is now set. If a verified engine speed nMOT was detected (interrogation result S1: no), then at S2 an interrogation is carried out to determine whether the actual rail pressure pCR(IST) is greater than or equal to an initial value pSTART, for example, pSTART=800 bars. If this is the case (interrogation result S2: yes), then at S3 the switch S1 is moved into the position S1=2. The normal mode is now set. In normal mode, the PWM signal PWMDV is now computed as a function of the resultant set volume flow Vres(SL) at S4. If the interrogation at S2 reveals that the actual rail pressure pCR(IST) is less than the initial value pSTART (interrogation result S2: no), then at S5 another test is performed to determine by the position of the switch S1 which mode is presently set. If normal mode is set (interrogation result S5: yes), then program control flows to S4. Otherwise, at S6 a PWM signal PWMDV with the value zero is output, and the program ends.

Figure 9:
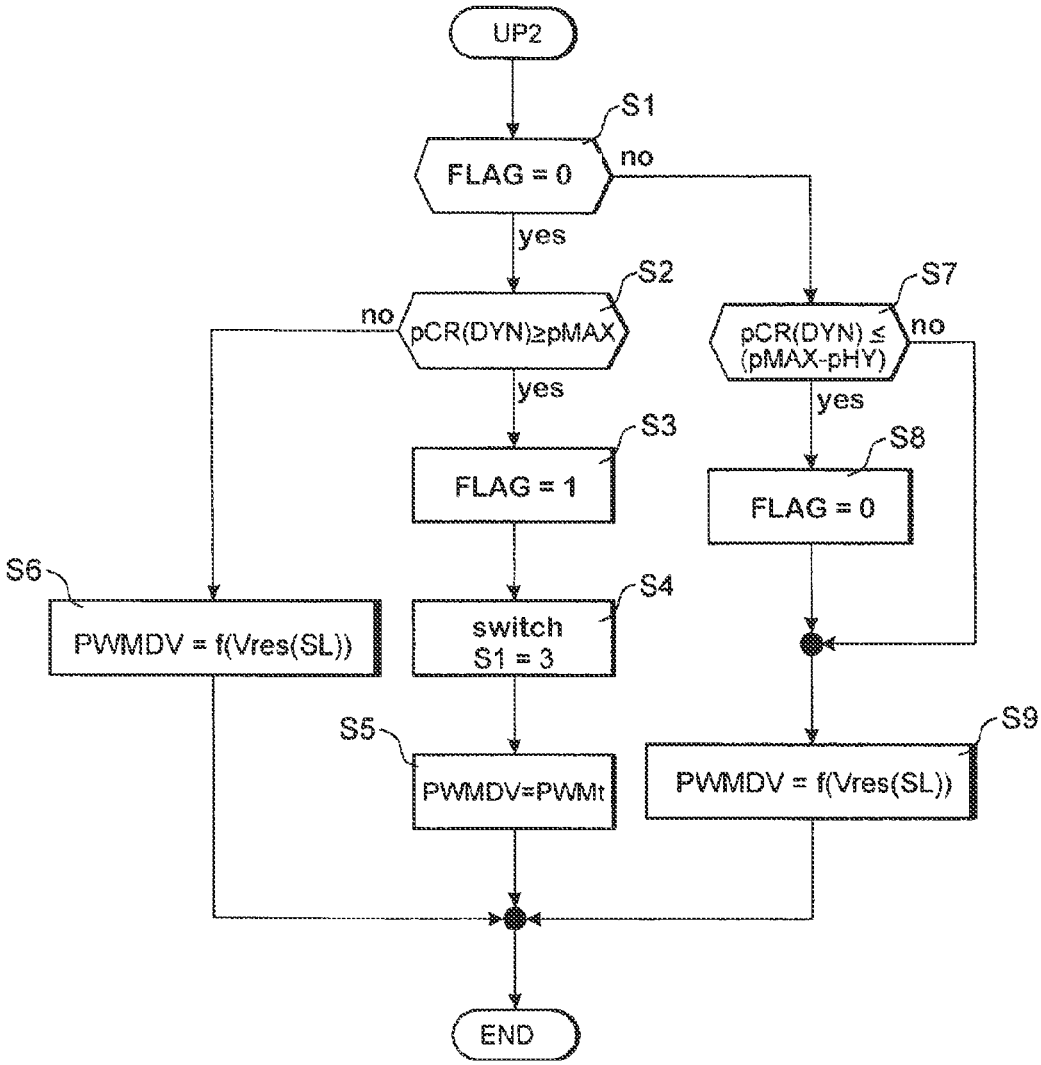
FIG. 9 is a second subroutine

FIG. 9 is a second subroutine UP2 showing the transition from normal mode to protective mode. At S1 the state of the flag is checked. Swinging back and forth between normal mode and protective mode is prevented by the flag. If the flag is equal to zero, the routine with the steps S2 to S6 is carried out. Otherwise, the routine with the steps S7 to S9 is carried out. If it was determined at S1 that the flag is equal to zero, then a check is made at S2 to determine whether the dynamic rail pressure pCR(DYN) is greater than or equal to a maximum pressure value pMAX. If this is not the case (interrogation result S2: no), then at S6 the PWM signal PWMDV is further computed as a function of the resultant set volume flow Vres(SL), and the program ends. If the interrogation at S2 shows that the dynamic rail pressure pCR(DYN) has exceeded the maximum pressure value pMAX, then at S3 the flag is set to the value 1, thereby preventing the protective mode from being reset. At S4 the protective mode is set by moving the switch S1 into the position S1=3, and at S5 the PWM signal PWMDV is set to the value PWMt. The temporary PWM signal PWMt can be set, for example, to a value of PWMt=80%. The program is then ended.

If it was determined at S1 that the flag is not zero and thus the protective mode is not enabled (interrogation result S1: no), then at S7 the pressure level of the dynamic rail pressure pCR(DYN) is checked. If the dynamic rail pressure pCR(DYN) has fallen below the maximum pressure value pMAX by at least a certain hysteresis value pHY (interrogation result S7: yes), then at S8 the flag is set to the value zero, whereby the protective mode is enabled again. If the interrogation result at S7 is negative, then program control flows to S9 with the computation of the PWM signal PWMDV as a function of the resultant set volume flow Vres(SL), and then the program is ended.

Figure 10:
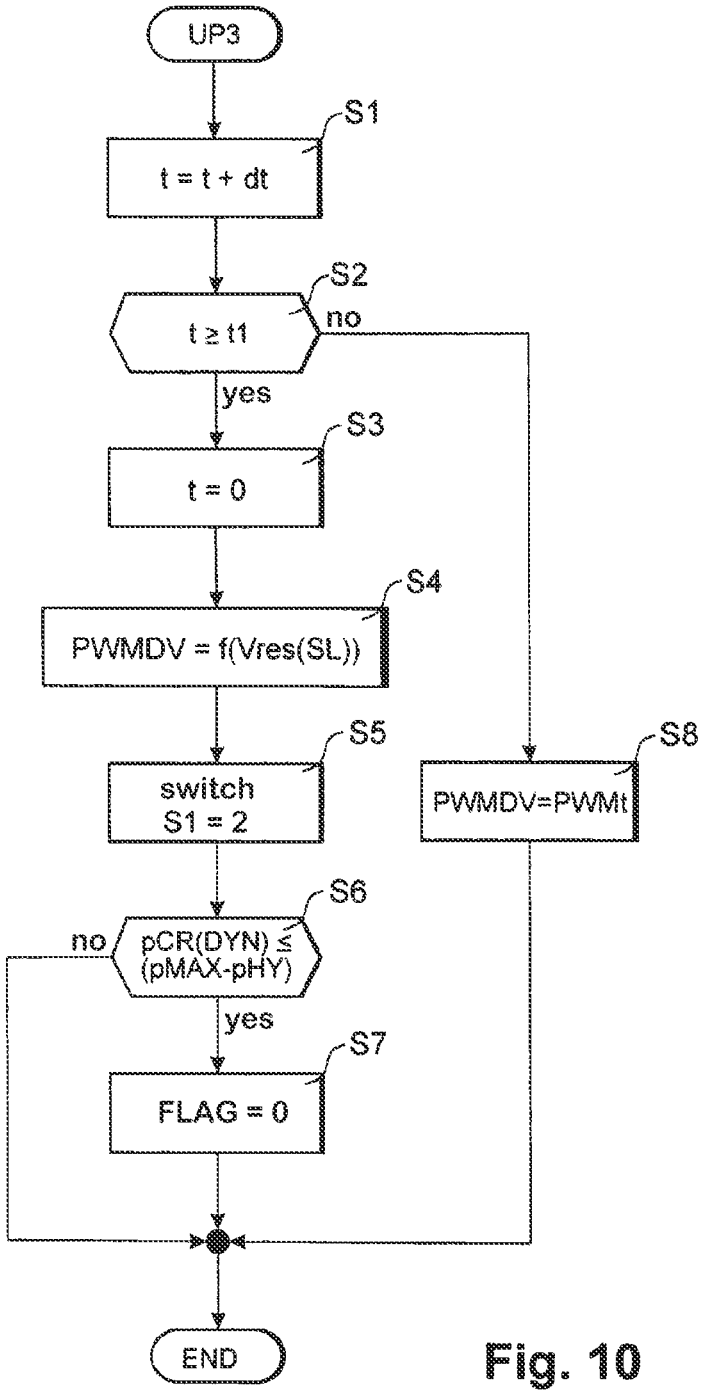
FIG. 10 is a third subroutine.

FIG. 10 is a third subroutine UP3 showing the transition from protective mode to normal mode. At S1 the time t is increased by dt. A check is then performed at S2 to determine whether the time t is greater than or equal to the time interval t1. If this is not the case, then at S8 the PWM signal PWMDV continues to be determined by the temporary PWM signal PWMt. The program is then ended. If it was determined at S2 that the time t is greater than or equal to the time interval t1 (interrogation result S2: yes), then at S3 the time t is set back to the value zero. At S4 the PWM signal PWMDV is then computed as a function of the resultant set volume flow Vres (SL), and at S5 the switch S1 is moved into the position S1=2, whereby the normal mode is then set. At S6 a check is performed to determine whether the dynamic rail pressure pCR (DYN) has fallen below the maximum pressure value pMAX by at least the hysteresis value pHY. If this is not the case, then program is ended. Otherwise, at S7 the flag is set to the value zero, thereby enabling the protective function again. The program is then ended.

FIG. 11 is a first time chart showing the startup of an internal combustion engine with a subsequent stop. FIG. 11 comprises five separate graphs 11A to 11E, which show the following as a function of time: the engine speed nMOT in FIG. 11A, the actual rail pressure pCR(IST) in FIG. 11B, the PWM signal PWMDV, by which the pressure control valve is operated, in FIG. 11C, the rail pressure disturbance variable VDRV in FIG. 11D, and the position of the switch S1 in FIG. 11E. The rail pressure disturbance variable VDRV represents the volume flow which is redirected from the rail into the fuel tank by the pressure control valve.

Figure 11A:
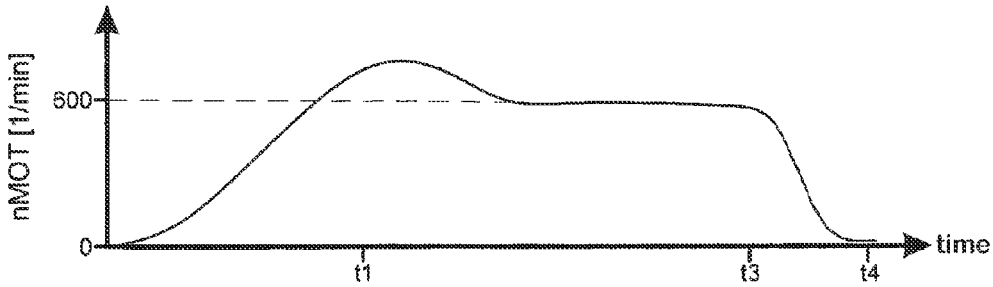
FIG. 11 is a first time chart.
Figure 11B:
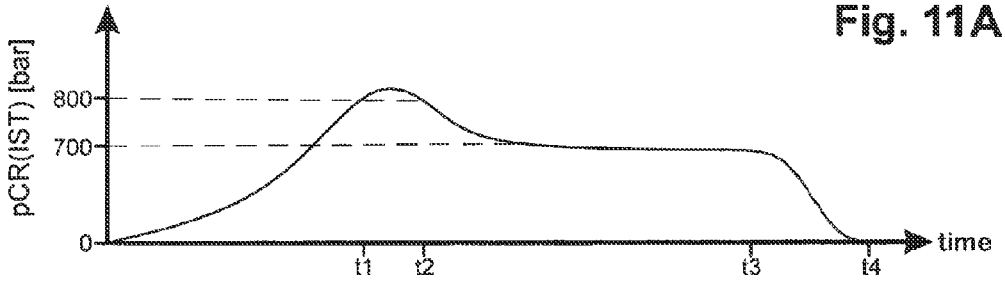
Figure 11C:
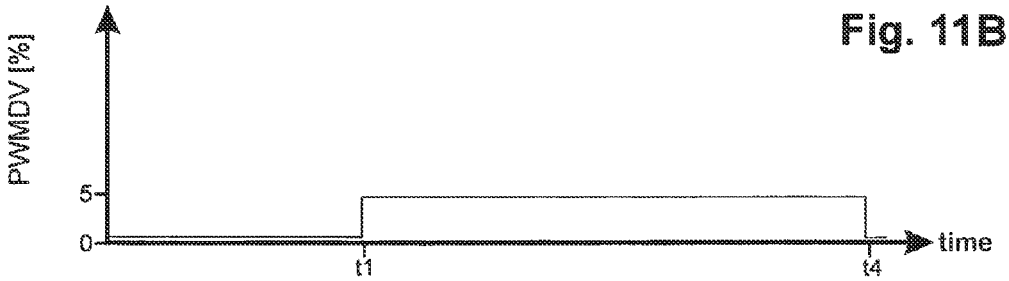
Figure 11D:
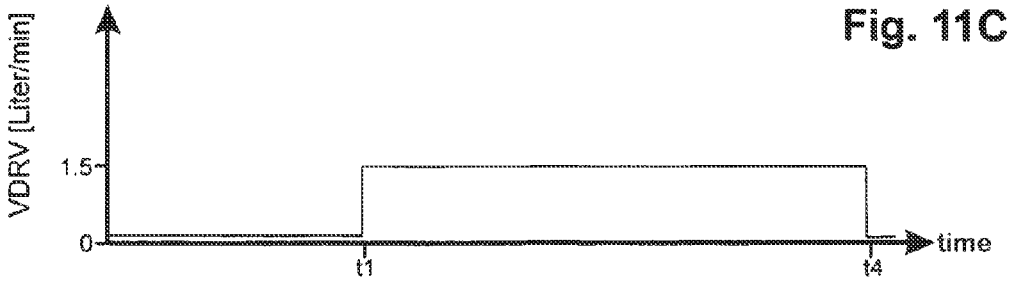
Figure 11E:
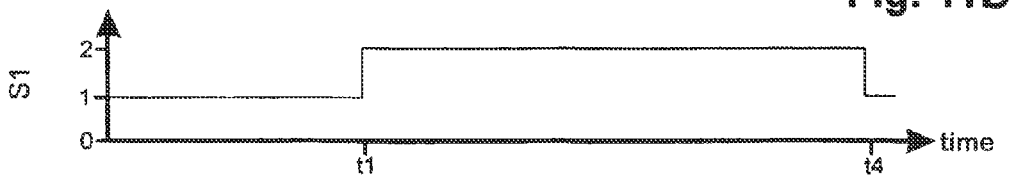

The engine speed nMOT first rises to the idle speed nMOT=600 rpm (FIG. 11A). As soon as a verified engine speed is detected, i.e., as soon as the crankshaft is rotating, one of the conditions for transition from shutdown mode to normal mode is satisfied. The actual rail pressure pCR(IST) also rises after the internal combustion engine has been started. If the actual rail pressure pCR(IST) exceeds the initial value of pSTART=800 bars at t1, then the second necessary condition is satisfied. Now shutdown mode is terminated and normal mode is set by moving the switch S1 from the position S1=1 to the position S1=2 at time t1. The pressure control valve is now activated. In this example, the PWM signal assumes the value PWMDV=5% (see FIG. 11C). The pressure control valve redirects a volume flow of 1.5 liters/min as the rail pressure disturbance variable. The actual rail pressure pCR(IST) then approaches and settles at the idle value of pCR(IST)=700 bars. The switch S1 remains unchanged in its position S1=2, even when the actual rail pressure pCR(IST) falls back below the initial value pSTART=800 bars at time t2 (FIG. 11B). The PWM signal continues to have the value PWMDV=5%, and a volume flow of 1.5 liters/min continues to be redirected. The engine speed nMOT and the actual rail pressure pCR(IST) then both fall to a value of zero, and at time t4 engine shutdown is detected. This has the consequence that normal mode is terminated and shutdown mode is set instead, i.e., the switch S1 changes its position from S1=2 to S1=1 (FIG. 11E). The PWM signal PWMDV is then no longer computed but rather is set to the value zero. Therefore, no fuel volume flow is now being redirected, and VDRV thus assumes a value of 0 liters/min.

FIG. 12 is a second time chart showing the transition from normal mode to protective mode. FIG. 12 comprises five separate graphs 12A to 12E, which show the following as a function of time: the dynamic rail pressure pCR(DYN) in FIG. 12A, the PWM signal PWMDV, with which the pressure control valve is controlled, in FIG. 12B, the rail pressure disturbance variable VDRV, which represents the redirected volume flow, in FIG. 12C, the position of the switch S1 in FIG. 12D, and the value of the flag in FIG. 12E.

At time t1, a load reduction occurs, for example, because the generator load is disconnected, which causes the dynamic rail pressure pCR(DYN) to rise from an initial value of pCR (IST)=2200 bars. At time t2, the dynamic rail pressure pCR (DYN) reaches the maximum pressure value pMAX=2320 bars. Since the flag previously had the value zero, the protective function was enabled, so that the PWM signal PWMDV is now temporarily set to the value PWMDV=PWMt=100% by switching the switch S1 from the position S1=2 to the position S1=3. In other words, the normal mode is terminated and the protective mode is set. With the protective mode set, a volume flow of 4 liters/min as the rail pressure disturbance variable is now redirected into the fuel tank by the pressure control valve. At the same time, with the protective mode set, the flag is set to the value 1 (FIG. 12E), which results in the protective mode being blocked. At time t3, time interval t1 has elapsed. With the expiration of time interval t1, protective mode is terminated and normal mode is set by switching the switch S1 from the position S1=3 to the position S1=2. As a result, the redirected volume flow assumes the value 0 liters/min. At time t4, the dynamic rail pressure pCR(DYN) falls below the maximum pressure value pMAX=2320 bars by a hysteresis value pHY=70 bars. This causes the flag to be changed from the value 1 to the value 0, which means that the protective mode is enabled again.

Figure 12A:
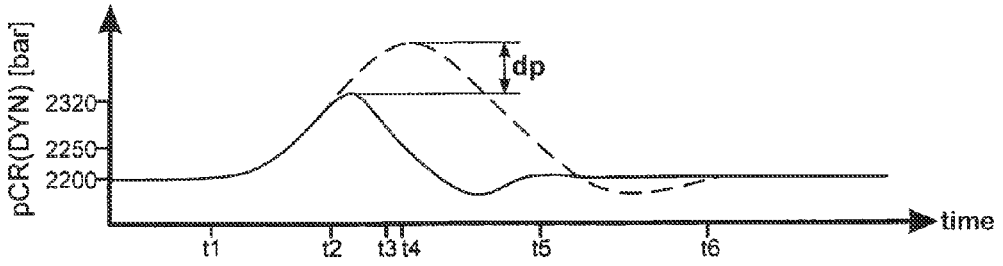
FIG. 12 is a second time chart.
Figure 12B:
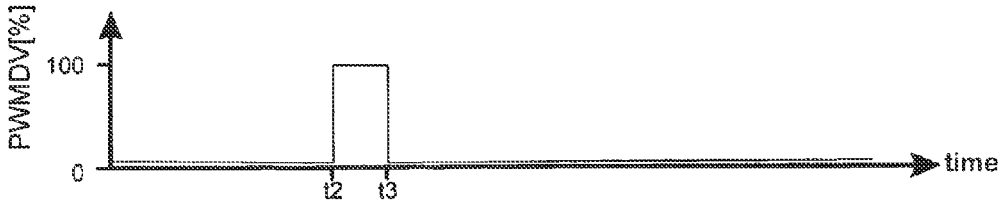
Figure 12C:
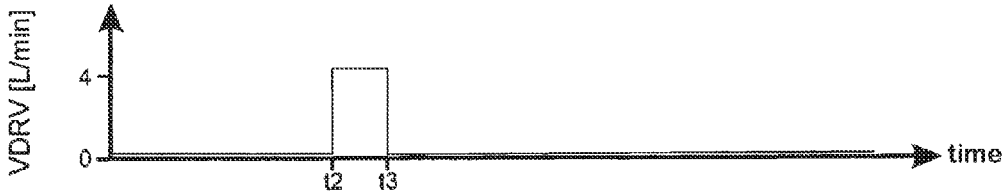
Figure 12D:
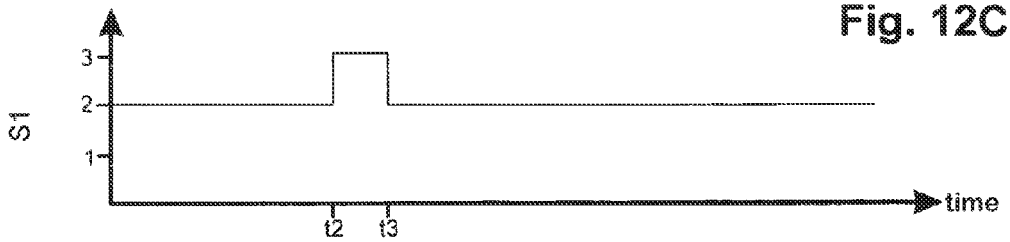
Figure 12E:
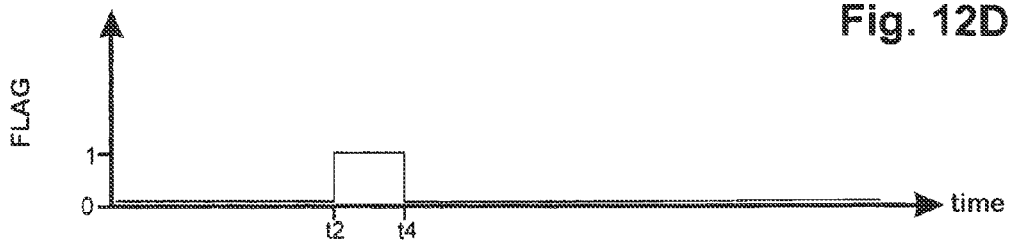

In FIG. 12A, a broken line is drawn for comparison to show the behavior of the dynamic rail pressure pCR(DYN) without the protective mode. It is clear that the protective mode significantly reduces the amount of overshoot of the dynamic rail pressure pCR(DYN). This amount is indicated in the graph by the reference symbol dp.

In the description of the figures, a PWM signal was used in positive logic for controlling the pressure control valve, i.e., when the value of the PWM signal PWMDV is positive, the pressure control valve is acted upon in the opening direction (increasing opening cross section). Naturally, the control can also be realized in negative logic analogously to the suction throttle. In this case, the pressure control valve is completely open at a PWM value of PWMDV=0.

The advantages of the method of the invention may be summarized as follows:

- overshooting of the rail pressure, in this case, dynamic rail pressure, during a load change at the power take-off of the internal combustion engine is significantly reduced;
- the reduced overshoot results in a shorter correction time and thus a shorter response time;
- the mechanical system, especially the rail, is effectively protected from pressure peaks;
- an opening of the passive pressure control valve is limited to actual emergencies;
- the method of the invention can be used to supplement the known method of rapid energization of the suction throttle when a load reduction occurs (DE 10 2005 029 138 B3);
- the buildup of rail pressure during startup occurs unhindered.

LIST OF REFERENCE NUMBERS

1 internal combustion engine
2 fuel tank
3 low-pressure pump
4 suction throttle
5 high-pressure pump
6 rail
7 injector
8 individual accumulator (optional)
9 rail pressure sensor
10 electronic control unit (ECU)
11 pressure control valve, passive
12 pressure control valve, electrically controllable
13 closed-loop rail pressure control system
14 pressure controller
15 limiter
16 pump characteristic curve
17 computing unit for PWM signal
18 controlled system
19 first filter

20 second filter
21 open control system
22 computing unit
23 pressure control valve input-output map
24 closed-loop current control system (pressure control valve)
25 current controller
26 filter
27 set volume flow input-output map
28 set consumption computing unit
29 dynamic correction unit
30 limiter
31 characteristic curve
32 controller
33 shutdown mode
34 normal mode
35 protective mode

The invention claimed is:

1. A method for open-loop and closed-loop control of an internal combustion engine, comprising the steps of: automatically controlling rail pressure (pCR) in a closed-loop rail pressure control system by a suction throttle on a low-pressure side as a first pressure regulator; generating a rail pressure disturbance variable (VDRV) for influencing the rail pressure (pCR) by way of a pressure control valve on a high-pressure side as a second pressure regulator, by which fuel is redirected from a rail into a fuel tank; setting a shutdown mode when an engine shutdown is detected, where the PWM signal (PWMDV) is output with a value of zero when the shutdown mode is set; terminating the shutdown mode and setting a normal mode when an actual rail pressure (pCR (IST)) exceeds an initial value (pSTART) and a verified engine speed (nMOT) is detected; and determining an opening/closing position of the pressure control valve by a PWM signal (PWMDV) by computing the PWM signal (PWMDV) as a function of a resultant set volume flow (Vres(SL)) when the normal mode is set, including setting a protective mode when a dynamic rail pressure (pCR(DYN)) exceeds a maximum pressure value (pMAX) and the protective mode is enabled, and temporarily setting the PWM signal (PWMDV) to a maximum value when the protective mode is set.

2. The method in accordance with claim 1, wherein after a time interval has elapsed, the temporary PWM signal is ended, the protective mode is terminated, and the normal mode is set again.

3. The method in accordance with claim 2, wherein when normal mode is set, the protective mode is enabled again when the dynamic rail pressure (pCR(DYN)) falls below the maximum pressure value (pMAX) by at least a hysteresis value (pHY).

4. The method in accordance with claim 1, wherein when normal mode is set, the normal mode is terminated and the shutdown mode is set again when an engine shutdown is detected.

5. The method in accordance with claim 1, including computing the resultant set volume flow (Vres(SL)) from a static set volume flow (Vs(SL)) and a dynamic set volume flow (Vd(SL)).

6. The method in accordance with claim 5, including computing the static set volume flow (Vs(SL)) of the pressure control valve by a set volume flow input-output map as a function of a set injection quantity (QSL) and an engine speed (nMOT).

7. The method in accordance with claim 5, including computing the dynamic set volume flow (Vd(SL)) of the pressure control valve by a dynamic correction unit as a function of a set rail pressure (pCR(SL)) and an actual rail pressure (pCR (IST)) or a dynamic rail pressure (pCR(DYN)).

8. The method in accordance with claim 7, including computing the actual rail pressure (pCR(IST)) from the rail pressure (pCR) by a first filter and computing the dynamic rail pressure (pCR(DYN)) from the rail pressure (pCR) by a second filter.

* * * * *